US005097766A

United States Patent [19]

Campoli et al.

[11] Patent Number: 5,097,766

[45] Date of Patent: Mar. 24, 1992

[54] KINETIC ENERGY PROJECTILE WITH PYROTECHNIC PAYLOAD

[75] Inventors: Ralph F. Campoli, Mine Hill, N.J.; Earl R. Edmondson, St. Petersburg, Fla.; David A. Edmonds, Palm Harbor, Fla.; Joseph G. Buzzett, Tampa, Fla.

[73] Assignee: Olin Corporation, Cheshire, Conn.

[21] Appl. No.: 533,324

[22] Filed: Jun. 5, 1990

[51] Int. Cl.[5] ..... F42B 12/04; F42B 12/44

[52] U.S. Cl. ..... 102/364; 102/473; 102/513; 102/517; 102/703

[58] Field of Search ..... 102/334, 364, 367, 473, 102/513, 517-519, 703

[56] References Cited

U.S. PATENT DOCUMENTS

| | | | |
|---|---|---|---|
| 3,302,570 | 2/1967 | Marquardt | 102/364 |
| 3,677,181 | 7/1972 | Giljarhus | 102/364 |
| 3,695,951 | 10/1972 | Helm, Jr. et al. | 149/19 |
| 3,710,723 | 1/1973 | Muller et al. | 102/513 |
| 3,902,424 | 9/1975 | Dietsch et al. | 102/513 |
| 3,935,817 | 2/1976 | Riparbelli | 102/703 |
| 3,980,021 | 9/1976 | Strandli | 102/364 |
| 4,002,121 | 1/1977 | Prochnow et al. | 102/364 |
| 4,216,721 | 8/1980 | Marziano et al. | 102/364 |
| 4,671,181 | 6/1987 | Romer et al. | |

*Primary Examiner*—Harold J. Tudor
*Attorney, Agent, or Firm*—J. R. Wahl

[57] ABSTRACT

A long rod penetrator projectile comprises an elongated main penetrator body, a stabilizing fin assembly attached to the rear of the main body, and a perforated canister carried within the fin assembly. A pyrotechnic material such as pyronol is contained within the canister. The pyronol ignites during impact. The burning pyrotechnic material spews forth through the perforations in the canister to provide improved after armor effects.

13 Claims, 2 Drawing Sheets

KINETIC ENERGY PROJECTILE WITH PYROTECHNIC PAYLOAD

BACKGROUND OF THE SUMMARY

This invention generally relates to armor penetrating projectiles and more particularly to a kinetic energy penetrator projectile having a tail portion carrying a pyrotechnic material to increase after armor effects.

This application is related to copending U.S. Pat. No. 07/398,022, filed May 5, 1989.

Kinetic energy projectiles and particularly arrow shaped projectiles are conceived to destroy various types of armored vehicles. The long rod shape of the penetrator core, which is made of a dense hard metal such as tungsten, creates a high pressure condition behind the armor as it punches through the armor plate and also produces substantial spalling as the penetrator punches through into the interior of the vehicle. However, the after armor effects are limited with a long rod penetrator by itself. If the armor is not heavy, the spalling will be minimal and the pressure rise insubstantial. Accordingly, some kinetic energy projectile designs have included provisions for carrying an incendiary material to increase hole size and the spalling or a high explosive behind the penetrator to increase the lethality of the projectile behind the armor plate.

One such kinetic energy projectile is disclosed in U.S. Pat. No. 4,671,181 issued to Romer et al. This patent discloses a subcaliber, long rod penetrator which has a steel jacket that extends rearwardly of the rod shaped penetrator core to form a tail cavity. A winged tail fin assembly with a central hub is screwed or press fit into the jacket rearwardly of this core. A pyrotechnic incendiary charge is housed within the hub and the cavity behind this penetrator core. Upon upset, and passage of the core through the target armor plate, this tail unit is stripped away from the core and arrested by the armor adjacent the hole formed by the penetrator core, exposing and igniting the pyrotechnic material therein. The burning pyrotechnic material burns in the hole, widening it, so as to further destroy the armor. Thus, contact of the tail unit with the arresting armor plate exposes the pyrotechnic incendiary charge and causes it to ignite while the penetrator core continues to move through the remainder of the armor. The burning incendiary in the target armor in this design increases the destruction of the surrounding armor during penetration. This design, however, does not substantially increase the after armor effects of the kinetic energy projectile.

It is therefore an objective of the present invention to increase and improve the after armor effects of a kinetic energy projectile. It is a further object of the invention to provide a kinetic energy projectile which carries self igniting pyrotechnic grenade into the interior of the vehicle to increase the after armor effects.

The kinetic energy projectile in accordance with the present invention is designed to overmatch the target armor. The projectile comprises a long, rod shaped main penetrator body having a generally pointed front tip, and a stabilizing fin assembly attached to the rear portion of the main penetrator body. The stabilizing fin assembly forms a housing behind the main penetrator body for carrying a perforated canister containing a pyrotechnic material. This pyrotechnic material ignites during the penetration of the armor target plate and the canister becomes separated from the main penetrator body following penetration through the armor plate. The burning pyrotechnic material spews forth through the perforations in the canister to enhance the after armor effects of the overmatching projectile. Thus, the pyrotechnic material containing canister is effectively a pyrotechnic grenade which burns inside of the target tank or other armored vehicle creating very lethal high temperatures.

These and other features, objects, and advantages will become more apparent from a reading of the following detailed description taken in conjunction with the drawing and appended claims.

DETAILED DESCRIPTION OF THE INVENTION

Figure 1:
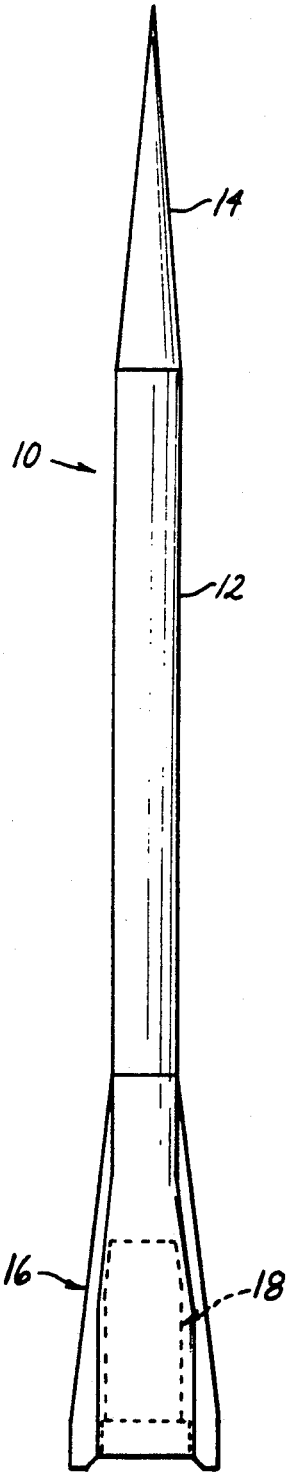
FIG. 1 is a side view of an arrow shaped penetrator projectile in accordance with the present invention.
Figure 2:
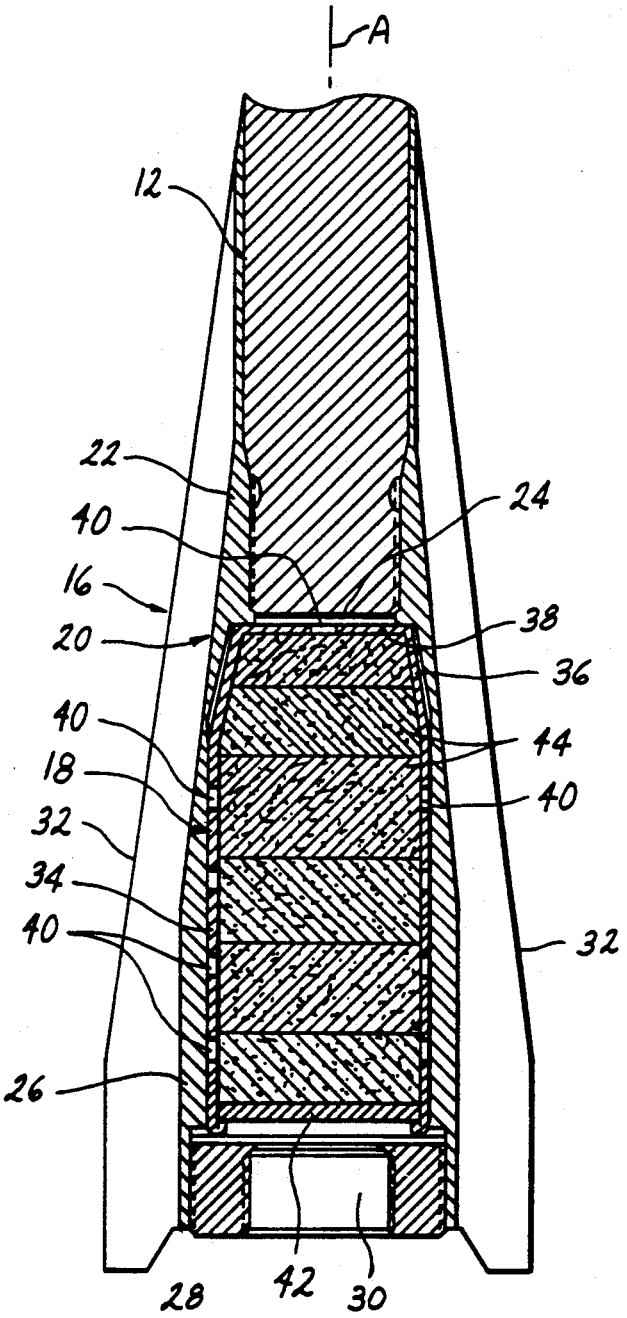
FIG. 2 is an enlarged partial sectional view of the rear portion of the projectile shown in FIG. 1.

A kinetic energy projectile 10 in accordance with the present invention is illustrated in FIG. 1. The projectile 10 comprises a long rod main penetrator body portion 12, a generally conical front tip portion 14, and a coaxial finned tail assembly 16 mounted to the rear of penetrator body portion 12 housing therein a perforated canister 18 which contains a pyrotechnic material.

The finned tail assembly 16 is a generally cylindrical hollow housing 20 generally symmetrical about a central longitudinal axis A of the projectile 10. The front portion 22 of the housing 20 is preferably threaded on to the rear end 24 of the main penetrator body 12. The rear portion 26 of housing 20 is threaded to receive a tracer cup 28 which in turn optionally receives a conventional tracer compound 30. A plurality of fins 32 are preferably integral with or may alternatively be fastened to and extend radially from housing 20 to provide aerodynamic stabilization of the long rod penetrator projectile 10 during flight.

The front portion 22 of the housing 20 has a slight taper so as to present a low drag cone shape extending rearwardly from its attachment to the penetrator body 12. The rear portion 26 of the housing 20 preferably has an outer diameter greater than the diameter of main penetrator body 12. The diameter of the housing 20 is preferably less than about 1.5 times the diameter of main penetrator body 12 to facilitate passage of the canister 18 through the hole formed in the target armor plate. The plurality of fins 32 may be made of steel or may be preferably made of a light weight material such as aluminum. The generally cylindrical housing 20 is preferably made of steel. The canister 18 is also preferably made of a steel.

The pyrotechnic containing canister 18 is sandwiched between the tracer cup 28 and the rear end 24 of the main penetrator body 12 within the housing 20. One preferred embodiment of the canister 18 has a generally tubular shape thin side wall 34 having an outer diameter larger than the penetrator body 12. The wall 34 tapers at the forward end 36 into a flat radial front wall 38 which butts against the front end 22 of housing 20. The front wall 38 preferably has at least one aperture or perforation 40 therethrough. Similarly, canister side wall 34 may have a plurality of apertures 40 axially and radially spaced about the canister wall 34. The rear of canister 18 is closed by a generally flat closure disk 42.

A plurality of pyrotechnic pellets 44 are preferably axially stacked within the canister 18. These pyrotechnic pellets may alternatively be a single cylindrical mass or may be multiple smaller pellets, depending upon the particular composition and character of the pyrotechnic material used.

One preferable pyrotechnic material consists essentially of Pyronol pellets. The pellets are preferably tandemly stacked within the canister 18. This pyrotechnic material is described in detail in U. S. Pat. No. 3,695,951 which is incorporated herein by reference.

These Pyronol pellets are a self oxidizing pyrotechnic material which consists essentially of a mixture of nickel, aluminum, iron oxide, and a fluorocarbon. No oxygen is required for ignition of this material. The only requirement is that a portion of the mixture reach a temperature of at least 660° C. Upon reaching this temperature, a nonexplosive exothermic reaction generating temperature of 2400°2800° C. occurs which forms molten metal and oxide products at extreme pressures. These products are ejected from the canister 18 through the apertures 40 at high velocity.

Figure 3:
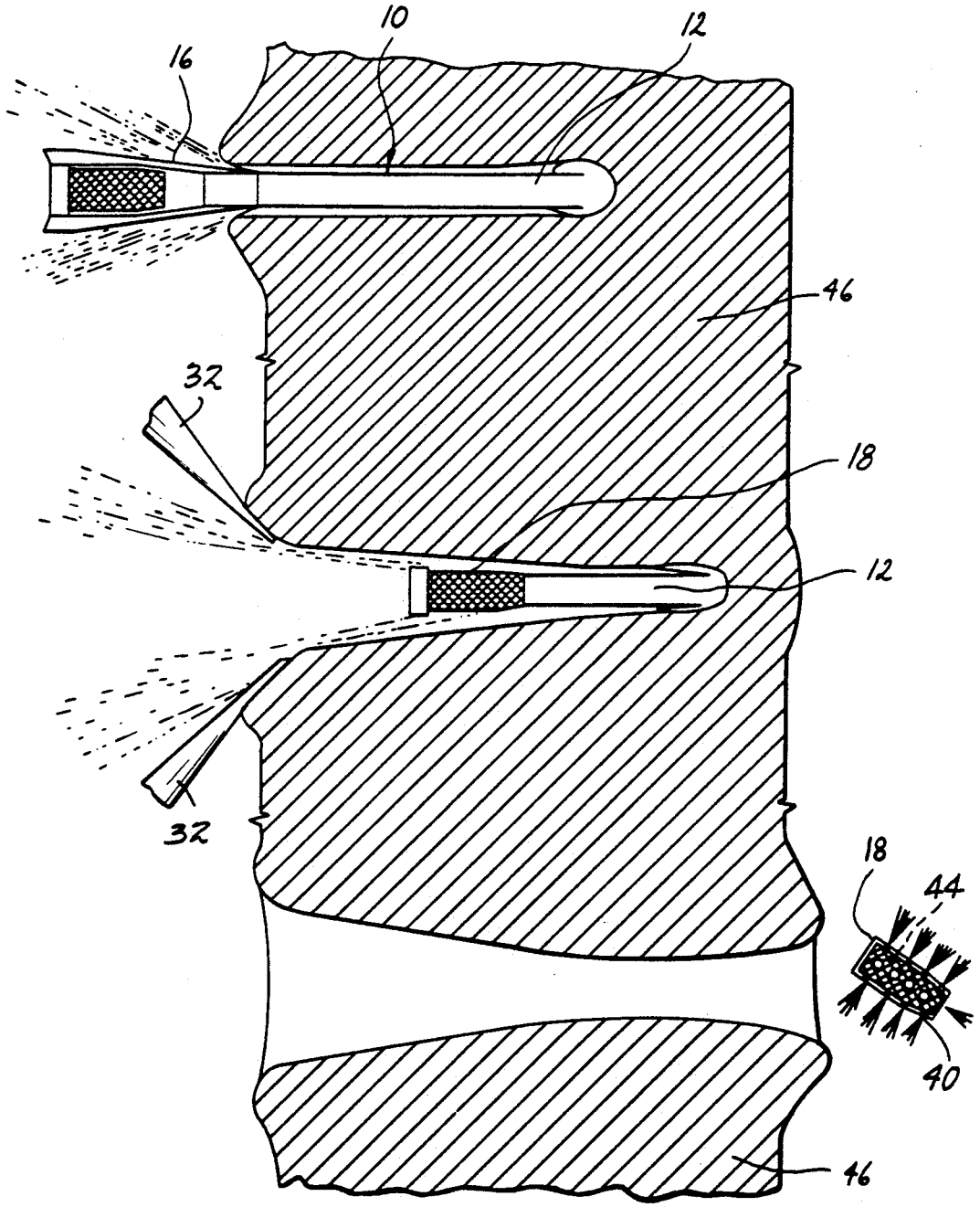
FIG. 3 is an illustration of the penetration sequence of the kinetic energy penetrator in accordance with the present invention passing through an armor plate.

The long rod penetrator projectile 10 in accordance with the present invention is designed to penetrate heavy rolled homogeneous armor (RHA) and to properly function must overmatch the armor such that canister 18 passes completely through the armor. As shown in FIG. 3, when the penetrator projectile begins to penetrate through the target RHA 46, the front end 14 will erode due to intense pressure and heat generated during impact. Further penetration into the armor 46 causes further erosion of penetrator 12 and causes the fins 32 to be stripped from the housing 20. This penetration process creates substantial heat and friction as the penetrator continues its passage through the RHA 46 and creates a hole larger than the penetrator diameter. The frictional heat generated during penetration far surpasses the ignition temperature requirement of 660° C., causing the pyrotechnic pellets 44 in canister 18 to ignite and the canister to separate from main penetrator body 12. The burning pellets 44 then spew forth molten metal and oxide products as illustrated skematically in the lower portion of FIG. 3. These molten metal and oxide products, discharged through apertures 40 in canister 18 after the canister 18 has passed through the RHA substantially increase the after armor effects of the penetrator projectile.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. An overmatching kinetic energy projectile for penetrating through heavy armor comprising:

a long rod shaped penetrator body having a rear end portion, an outer diameter and a generally pointed front end portion;

a generally cylindrical open ended hollow housing having a through bore attached coaxially to said rear end portion, said housing having a tapered front portion and having a maximum outer diameter less than 1.5 times the outer diameter of said penetrator body; and a hollow canister having a thin wall disposed within said housing, said canister containing a self igniting pyrotechnic material.

2. The projectile according to claim 1 wherein said housing has a plurality of stabilizing fins projecting radially outward from said housing so as to stabilize said projectile during flight.

3. The projectile according to claim 1 wherein said housing has a threaded front end portion engaged with corresponding threads on said rear end portion of said penetrator body.

4. The projectile according to claim 1 wherein said canister has a front end wall having at least one aperture therethrough.

5. The projectile according to claim 1 wherein said canister wall has a plurality of apertures therethrough.

6. The projectile according to claim 1 wherein said canister has a tapered front portion, a cylindrical body portion and a rear portion, said body portion having an outer diameter greater than that of said penetrator body.

7. The projectile according to claim 1 further comprising said housing having an open tail end portion supporting a tracer cup secured behind said canister.

8. The projectile according to claim 7 wherein said housing further comprises a plurality of aluminum stabilizing fins projecting radially outward from said housing so as to stabilize said projectile during flight.

9. The projectile according to claim 1 wherein said canister further comprises a tapered front portion, a cylindrical body portion and a rear portion, said front portion terminating in a front end wall having at least one aperture therethrough.

10. The projectile according to claim 9 wherein said cylindrical body portion of said canister has a plurality of apertures therethrough.

11. The projectile according to claim 1 wherein said pyrotechnic material comprising a metal, iron oxide, and a fluorocarbon.

12. The projectile according to claim 11 wherein said material consists essentially of a mixture of nickel, aluminum, iron oxide and a fluorocarbon.

13. The projectile according to claim 12 wherein said material is a plurality of pellets arranged sequentially in said canister.

* * * * *

UNITED STATES PATENT AND TRADEMARK OFFICE

CERTIFICATE OF CORRECTION

PATENT NO. : 5,097,766

DATED : March 24, 1992

INVENTOR(S) : Ralph F. Campoli et al

It is certified that error appears in the above—identified patent and that said Letters Patent is hereby corrected as shown below:

In column 4, line 58 after "of" insert -- Pyronol--

Signed and Sealed this

Fourteenth Day of September, 1993

Bruce Lehman

*Attest:*

BRUCE LEHMAN

*Attesting Officer*

*Commissioner of Patents and Trademarks*